US009140247B2

(12) United States Patent
Herre et al.

(10) Patent No.: US 9,140,247 B2
(45) Date of Patent: Sep. 22, 2015

(54) ROTARY PISTON PUMP FOR METERING A COATING AGENT

(75) Inventors: Frank Herre, Oberriexingen (DE); Rainer Melcher, Oberstenfeld (DE); Manfred Michelfelder, Steinheim (DE); Steffen Sotzny, Oberstenfeld (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 389 days.

(21) Appl. No.: 13/391,502

(22) PCT Filed: Aug. 2, 2010

(86) PCT No.: PCT/EP2010/004715

§ 371 (c)(1),
(2), (4) Date: Feb. 21, 2012

(87) PCT Pub. No.: WO2011/020552

PCT Pub. Date: Feb. 24, 2011

(65) Prior Publication Data

US 2012/0186518 A1 Jul. 26, 2012

(30) Foreign Application Priority Data

Aug. 21, 2009 (DE) ..... 10 2009 038 462

(51) Int. Cl.

| | |
|---|---|
| ***F04B 7/06*** | (2006.01) |
| ***F04B 23/06*** | (2006.01) |
| ***B05B 9/04*** | (2006.01) |
| ***F04B 9/04*** | (2006.01) |

(Continued)

(52) U.S. Cl.

CPC ..... *F04B 23/06* (2013.01); *B05B 9/0403* (2013.01); *F04B 7/06* (2013.01); *F04B 9/047* (2013.01); *F04B 11/005* (2013.01); *F04B 13/00* (2013.01); *F04B 15/02* (2013.01); *B05B 3/10* (2013.01); *B05B 7/00* (2013.01)

(58) Field of Classification Search

CPC ..... F04B 1/124; F04B 1/128; F04B 1/14; F04B 1/146; F04B 7/04; F04B 7/06; F04B 27/10; F04B 27/1054; F04B 27/1036

USPC ..... 417/269–271, 301, 307, 500; 92/71; 91/499

See application file for complete search history.

(56) References Cited

U.S. PATENT DOCUMENTS 1,238,939 A * 9/1917 Pflegger ..... 417/500
2,215,827 A * 9/1940 Ditto ..... 417/269

(Continued)

FOREIGN PATENT DOCUMENTS

| | | |
|---|---|---|
| CA | 2695364 | 3/2009 |
| CN | 1390281 | 1/2003 |

(Continued)

OTHER PUBLICATIONS

International Search Report, PCT/EP2010/004715, Dated Nov. 28, 2011.

*Primary Examiner* — Peter J Bertheaud
(74) *Attorney, Agent, or Firm* — Bejin Bieneman PLC

(57) ABSTRACT

Exemplary illustrations directed to a rotary piston pump, e.g., for metering a coating agent in a coating installation, as well as exemplary methods of using the same, are disclosed. An exemplary piston pump may comprise a plurality of pump units, each having one cylinder and one rotary piston which carries out a wobbling or tumbling movement in the cylinder.

44 Claims, 13 Drawing Sheets

(51) Int. Cl.

| | |
|---|---|
| ***F04B 11/00*** | (2006.01) |
| ***F04B 13/00*** | (2006.01) |
| ***F04B 15/02*** | (2006.01) |
| *B05B 3/10* | (2006.01) |
| *B05B 7/00* | (2006.01) |

(56) References Cited

U.S. PATENT DOCUMENTS

| | | | | |
|---|---|---|---|---|
| 2,239,723 | A * | 4/1941 | Limpert et al. | 417/419 |
| 2,369,345 | A * | 2/1945 | Folke | 417/429 |
| 2,424,943 | A * | 7/1947 | Nicolls | 417/387 |
| 3,447,468 | A * | 6/1969 | Kinne | 417/403 |
| 3,498,229 | A * | 3/1970 | Prelesnik | 417/269 |
| 4,461,209 | A | 7/1984 | Washchynsky et al. | |
| 4,576,554 | A * | 3/1986 | Wagenseil et al. | 417/270 |
| 5,167,181 | A * | 12/1992 | Lee | 91/499 |
| 5,938,416 | A | 8/1999 | Saito et al. | |
| 2007/0196223 | A1 | 8/2007 | Hogan | |
| 2008/0138212 | A1 * | 6/2008 | Schwarzkopf et al. | 417/222.1 |
| 2011/0221100 | A1 | 9/2011 | Wesselky et al. | |

FOREIGN PATENT DOCUMENTS

| | | | |
|---|---|---|---|
| CN | 1954149 | | 4/2007 |
| DE | 2908332 | A1 | 9/1980 |
| DE | 4207318 | A1 | 9/1993 |
| DE | 4412703 | A1 | 10/1995 |
| DE | 102004036555 | A1 | 3/2005 |
| DE | 102008047118 | A1 | 4/2010 |
| EP | 0512688 | A2 | 11/1992 |
| EP | 0586280 | C | 3/1994 |
| EP | 1316869 | A2 | 6/2003 |
| EP | 1348487 | A1 | 10/2003 |
| JP | S5825445 | | 2/1983 |
| JP | H02144674 | | 6/1990 |
| JP | H10252643 | | 9/1998 |
| JP | 2001115951 | | 4/2001 |
| JP | 2011234850 | | 8/2001 |
| JP | 2001263223 | | 9/2001 |
| WO | WO-01/36820 | A1 | 5/2001 |
| WO | 2009027809 | | 3/2009 |

* cited by examiner

Filling phase

Close inlet and open outlet

Discharge phase

Close outlet and open inlet

ROTARY PISTON PUMP FOR METERING A COATING AGENT

CROSS-REFERENCES TO RELATED APPLICATIONS

This application is a National Stage application which claims the benefit of International Application No. PCT/EP2010/004715 filed Aug. 2, 2010, which claims priority based on German Application No. DE 10 2009 038 462.6, filed Aug. 21, 2009, both of which are hereby incorporated by reference in their entireties.

FIELD

The present disclosure relates to a wobble piston pump for metering a coating agent in a coating installation.

BACKGROUND

Various wobble piston pumps are known, e.g., from EP 1 348 487 A1. An essentially cylindrical wobble piston executes a wobble movement in a cylinder, consisting of an oscillating stroke movement and a superimposed rotary movement. The rotary movement of the wobble piston serves in this case to open and close an inlet or an opposite outlet in the cylinder, whereas the oscillating stroke movement fills the coating agent into the cylinder or ejects it from the cylinder. The wobble piston is in this case driven by a rotating drive shaft via a conversion gear mechanism, the conversion gear mechanism converting the pure rotary movement of the drive shaft into the wobble movement.

A disadvantage of this known wobble piston pump is the fact that the discharge flow of the wobble piston pump pulses greatly, which is undesirable when metering coating agents (e.g. paint) in a coating installation. Rather, it is desirable during use in a coating installation for metering paint for the discharge flow to be as constant as possible in compliance with the desired value.

Accordingly, there is a need for a correspondingly improved wobble piston pump.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
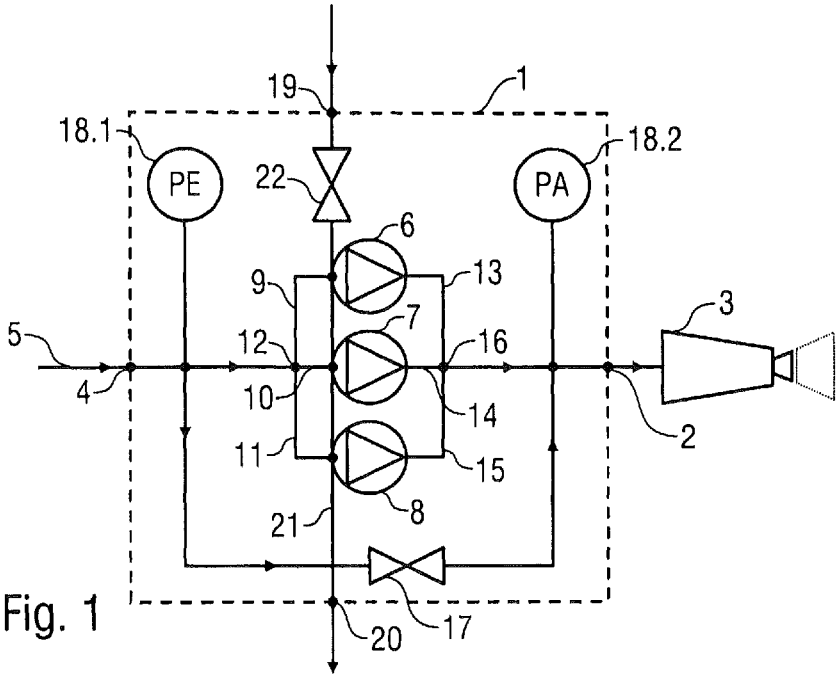
FIG. 1 a schematic representation of a wobble piston pump according to an exemplary illustration, FIG. 2 a perspective view of the exemplary wobble piston pump according to FIG. 1, FIG. 3 a partially cut away perspective view of the exemplary wobble piston pump according to FIGS. 1 and 2, FIG. 4 a simplified perspective view of a toothed gear mechanism in the exemplary wobble piston pump according to FIGS. 1 to 3, according to an exemplary illustration, FIG. 5 another perspective view of the toothed gear mechanism according to FIG. 4, FIG. 6 a perspective view of a wobble piston of the wobble piston pump according to FIGS. 1 to 5, according to an exemplary illustration, FIG. 7 a cut away perspective view of the wobble piston according to FIG. 6, FIG. 8 a schematic representation to illustrate the supply of coating agent to the individual pump units of the wobble piston pump according to an exemplary illustration, FIG. 9 a schematic perspective view to illustrate the outlet-side line routing, according to an exemplary illustration, FIG. 10 a schematic perspective view to illustrate the rinsing of the individual pump units of the wobble piston pump according to an exemplary illustration, FIG. 11A a perspective view of a piston rod seal of the wobble piston pump according to an exemplary illustration, FIG. 11B a cross-sectional view of the piston rod seal according to FIG. 11A, FIGS. 12A-12D various phases of the movement of a wobble piston in a pump unit of the wobble piston pump according to an exemplary illustration, FIG. 13 the chronological profile of the discharge flow of a wobble piston pump according to an exemplary illustration with two pump units, FIG. 14 the chronological profile of the discharge flow of a wobble piston pump according to an exemplary illustration with three pump units, FIG. 15 a control curve of a conversion gear mechanism for converting a rotary movement of the drive shaft into a wobble movement of the wobble piston, according to an exemplary illustration, FIG. 16 an exemplary modification of the control curve according to FIG. 15, FIG. 17 a further exemplary modification of the control curve according to FIG. 15, FIG. 18 a schematic representation of a multi-component pump for separate discharge of a plurality of components of a coating agent, according to an exemplary illustration, FIG. 19 a pump arrangement having a plurality of pumps, which are each connected to each other by means of clutches, according to an exemplary illustration, FIG. 20 a pump arrangement having a plurality of pumps, which are each connected to a common drive shaft by means of a clutch, according to an exemplary illustration, FIGS. 21A-21D the temporal course of the discharge flow in a pulsation-free wobble piston pump, according to an exemplary illustration, FIG. 22 a schematic representation of an exemplary wobble piston pump having three pump units and a bypass valve arranged with no dead space, FIG. 23 a schematic representation of an exemplary wobble piston pump having three pump units during piston rinsing, FIG. 24 a schematic representation of the inlet side of the wobble piston pump according to FIG. 1, and FIG. 25 a schematic representation of the outlet side of the wobble piston pump according to FIG. 1.

The exemplary illustrations comprise the general technical teaching of providing a plurality of pump units in a wobble piston pump, which units each have a cylinder and a wobble piston which executes a wobble or tumbling movement in the cylinder during operation.

The individual pump units each discharge in this case a pulsing discharge flow of the coating agent, as in the conventional wobble piston pump described at the beginning. In one exemplary illustration, the individual pump units are however connected on the outlet side to a common pump outlet, so that the discharge flows of the individual pump units are superimposed on each other, resulting in smoothing of the pulsation. Furthermore, the pump units of an exemplary wobble piston pump may also be connected on the inlet side to a common pump inlet, so that the pump units are filled with the coating agent via the common pump inlet.

On the one hand, the greatest possible number of parallel pump units is desirable in this case in order to minimise the pulsations of the discharge flow as far as possible. On the other hand, the complexity and weight of the wobble piston pump increase with the number of pump units in parallel. In one exemplary illustration, the wobble piston pump has three pump units in parallel, which may be a good compromise between the demand for the least possible pulsation of the discharge flow and the demand for the lowest possible weight.

The exemplary illustrations are not limited to wobble piston pumps having three pump units in parallel. Rather, it is also possible within the context of the exemplary illustrations to connect a larger or smaller number of pump units in parallel in the wobble piston pump. For example, the wobble piston pump according to the exemplary illustrations can have 2, 4, 5 or 6 pump units in parallel, merely as examples. The optimum number of pump units depends in this case on the requirements for uniformity of the discharge flow and for the weight of the wobble piston pump.

In another exemplary illustration, the wobble piston pump is suitable for separate discharge of a plurality of components (e.g. master batch paint and hardener) of the coating agent. This means that the different components of the coating agent do not have any contact with each other in the wobble piston pump, in order to prevent a chemical reaction between the different components. Therefore, at least one pump unit may be provided for each component of the coating agent. A plurality of pump units can also be provided for each component of the coating agent, which pump units are connected together on the outlet and/or inlet side and discharge the respective components together. This parallel connection of a plurality of pump units for a certain component in turn may effect a smoothing of the discharge flow of the respective component. For example, an exemplary wobble piston pump may have a total of six pump units, three pump units together discharging a first component (e.g. master batch paint) while the other three pump units together discharge a second component (e.g. hardener).

An exemplary wobble piston pump may be driven, for example, by a common drive shaft, which can for example be driven by an electric motor and thus rotates during operation. A conversion gear mechanism may then be arranged in each case between the rotating drive shaft and the individual pump units, which conversion gear mechanism converts the pure rotary movement of the common drive shaft into the combined wobble movement (rotary and stroke movement) of the wobble piston.

In principle, it is also possible for an exemplary wobble piston pump to be driven by means of a linearly oscillating drive element. In this case, too, a conversion gear mechanism may advantageously be arranged between the drive element and the individual pump units, which conversion gear mechanism then converts the linearly oscillating movement of the common drive element into the combined wobble movement.

If a wobble piston pump is driven by means of a common drive shaft, the power transmission may be effected from the common drive shaft to the different pump units by means of a toothed gear mechanism.

In one example, this toothed gear mechanism has an internal gear wheel with internal toothing and a plurality of planetary gear wheels, each with outer toothing, which engage in the internal gear wheel. The common drive shaft in this case drives the internal gear wheel so that the individual planetary gear wheels turn with a corresponding gear ratio, the individual planetary gear wheels each driving one of the pump units.

In another exemplary illustration, the toothed gear mechanism has a central sun wheel with outer toothing and a plurality of planetary gear wheels engaging in the sun wheel and each having outer toothing, the common drive shaft driving the central sun wheel so that the planetary gear wheels turn at a corresponding gear ratio. In this case, too, the individual planetary gear wheels of the toothed gear mechanism each drive one of the pump units.

However, the exemplary illustrations are not limited to the variants described above with respect to the design of the toothed gear mechanism. Rather, the force distribution from the common drive shaft to the different pump units can also be realised by other types of gear mechanism.

It has already been mentioned at the beginning that the parallel connection of a plurality of pump units in the wobble piston pump, e.g., according to one of the exemplary illustrations, allows a reduction in the pulsation of the discharge flow. To this end, the individual pump units may be driven with a certain phase difference, so that the time profile of the discharge flows of the individual pump units is correspondingly phase-offset. The phase difference is in this case may be equal to 360° divided by the number of pump units. For example, if there are three pump units in total, the phase difference between the individual pump units may therefore be 120°.

It should furthermore be mentioned that the individual wobble pistons may consist of a composite of different materials (e.g. ceramic and steel), which allows economical production and at the same time a long service life, and furthermore is associated with a low weight. In this case, the piston head (discharge head) of the wobble piston may consist of ceramic whereas the piston skirt (piston shaft) consists of steel. The two materials of the composite may be adhesively bonded, pressed or screw-fastened to each other, merely as examples. In technical experiments it has been found that silicon nitride, zirconium oxide and aluminum oxide may be particularly suitable as ceramic materials for the wobble piston.

It should generally be mentioned that the individual pump units may consist of low-wear materials. For example, the pump units can have pairs of materials in which both materials are hard. Alternatively, pairs of materials in which a relatively hard material is paired with a relatively soft material are also possible.

Furthermore, it is possible within the context of the exemplary illustrations for the individual pump units to be connected mechanically to a continuous drive shaft by means of a separable clutch. The individual pump units can in this case be coupled in and coupled out selectively. The pump unit which is to execute the discharge work is connected to the common drive shaft and driven while the remaining pump units are coupled out and therefore not driven.

Furthermore, it is possible for the common drive shaft to be divided into a plurality of drive shaft sections by means of a plurality of separable clutches, the individual drive shaft sections each driving at least one of the pump units. In this case, too, the pump units can be selectively coupled in and coupled out. When one of the clutches arranged in the drive shaft is separated, all the pump units that lie kinematically downstream of the separated clutch are however coupled out and therefore switched off, while the pump units which are kinematically upstream of the separated clutch (on the motor side) operate.

It has already been mentioned above that an exemplary wobble piston pump may be driven by a rotating drive shaft, the pure rotary movement of the drive shaft being converted into the combined wobble movement of the wobble piston by means of a gear mechanism. This means that the individual wobble pistons execute an oscillating stroke movement and a superimposed rotary movement. The conversion gear mechanism in this case controls the piston position of the wobble piston in compliance with a predefined control curve depending on the rotary angle of the drive shaft.

For example, the control curve of the conversion gear mechanism can be sinusoidal, which results in a corresponding sinusoidal stroke movement of the wobble piston.

However, it is also possible for the control curve to have a profile which deviates from a sine curve, so the stroke movement of the wobble piston is likewise non-sinusoidal.

In one exemplary illustration, the control curve of the conversion gear mechanism is stroke-free in a region around the dead centres of the piston movement, so the wobble pistons only execute a rotary movement in the stroke-free region in order to close or open the inlet or outlet. The stroke-free region of the piston movement can for example be a rotary angle range of the planetary gear wheels of at least 5°, 10°, 15°, 20°, 25° or even 30°. It is even possible for the stroke-free rotary angle range to be up to 60°.

It should furthermore be mentioned that the control curve of the conversion gear mechanism may define a discharge phase and a filling phase, the wobble piston pump receiving the coating agent in the filling phase and ejecting the received coating agent in the discharge phase. In this case it is possible for the control curve of the conversion gear mechanism to be shaped such that the discharge phases of the individual pump units join with no chronological gaps or overlaps in order to achieve a discharge flow with the least possible pulsation. Within the context of the exemplary illustrations, it is even possible for the wobble piston pump to output a pulsation-free discharge flow. The pulsation of the discharge flow may therefore be less than 5%, 3% or even less than 2%.

Furthermore, it is possible within the context of the exemplary illustrations for the control curve of the conversion gear mechanism to be shaped such that the stroke movement of the wobble piston is faster in the filling phase than in the discharge phase.

Alternatively, it is also possible for the control curve of an exemplary conversion gear mechanism to be shaped such that the stroke movement of the wobble piston is slower in the filling phase than in the discharge phase.

In one exemplary illustration, the control curve of the conversion gear mechanism may, however, be shaped such that the stroke movement of the wobble piston takes place in the filling phase and/or in the discharge phase at an essentially constant piston speed, which advantageously results in a correspondingly constant discharge flow and filling flow.

Furthermore, it is possible within the context of the exemplary illustrations for the control curves of the individual pump units to be different, which results in correspondingly different piston movements. This can for example be advantageous if an exemplary wobble piston pump discharges different components (e.g. master batch paint and hardener) of a coating agent, which generally requires a certain mixing ratio. Furthermore, different shapes of the control curves of the individual pump units in a multi-component pump allow a certain dynamic mixing process to be set, in which for example the first component is initially metered and then the second component, which can be realised by corresponding setting of the control curves.

The mixing ratio of a component A to a component B or a component C can be set by means of different piston strokes or different piston diameters.

In an exemplary illustration, the wobble piston pump has a common coating agent supply line for supplying the coating agent for all pump units. An inlet-side distributor point may be arranged in this coating agent supply line inside the wobble piston pump, from which distributor point a plurality of inlet-side branch lines branches off, which connect the inlet-side distributor point to the inlet of the individual pump units.

The inlet-side branch lines between the inlet-side distributor point and the pump units may have the same length. This may be advantageous, because the coating agent flowing in via the common coating agent supply line then also reaches the different pump units at the same time.

Furthermore, the inlet-side branch lines between the inlet-side distributor point and the pump units may have a kink-free profile in order to minimize flow resistance. Such a kink-free and continuously curved profile of the branch lines can be achieved for example by laser sintering technology or by what is known as rapid prototyping as described, for example, in DE 10 2008 047 118 and the corresponding U.S. Pat. Pub. No. US020110221100A1, so the content of these documents are each hereby expressly incorporated by reference in their entireties, including with respect to rapid prototyping.

The wobble piston pump may have a pump housing which can be produced by rapid prototyping. The pump housing can then be re-machined externally and/or internally. Cutting methods are for example suitable for the external re-machining. The internal re-machining can however be carried out for example by abrasive flow machining It should also be mentioned that the inlet-side branch lines between the inlet-side distributor point and the pump units may have a line profile with minimal flow resistance.

Furthermore, the inlet-side branch lines may connect the inlet-side distributor point to the pump units by the shortest route.

It should also be mentioned that the coating agent supply line and the inlet-side branch lines may be free of dead space in order to prevent deposits of the coating agent in the lines, keep paint losses in the pump as low as possible and minimize the rinsing time.

Furthermore, an exemplary wobble piston pump may have a common coating agent output line which receives and outputs the coating agent discharged by the individual pump units. An outlet-side distributor point may be arranged in the common coating agent output line inside the wobble piston pump, from which distributor point a plurality of outlet-side branch lines branches off to the outputs of the individual pump units.

These outlet-side branch lines may also have the above-mentioned properties of the inlet-side branch lines (e.g. kink-free, free of dead space etc.).

It should also be mentioned that the inlet-side distributor point may be connected to an inlet-side pressure sensor which measures the pump input pressure, it being possible for the inlet-side pressure sensor to be structurally integrated in an exemplary wobble piston pump. Furthermore, the outlet-side distributor point may also be connected to an outlet-side pressure sensor which measures the pump output pressure, and the outlet-side pressure sensor may also be structurally integrated in an exemplary wobble piston pump.

Furthermore, a wobble piston pump according to an exemplary illustration may allow rinsing, which can be necessary for example when the paint is changed. The exemplary wobble piston pump may have a rinsing agent inlet for supplying a rinsing agent and a rinsing agent outlet for returning a rinsing agent, and a rinsing agent line which leads from the rinsing agent inlet through the pump units to the rinsing agent outlet.

In one variant of the rinsing system, according to an exemplary illustration, the individual pump units are arranged consecutively along the rinsing agent line. The advantage of such a series routing of the rinsing agent through the individual pump units compared to a parallel duct routing is the prevention of blockages in the rinsing agent line. In a parallel routing of rinsing agent through the individual pumps, the rinsing agent would always take the path of lowest flow resistance, so individual flow paths could slowly clog.

In another exemplary illustration, the rinsing agent line branches into a plurality of parallel line branches which rinse the individual pump units. Such parallel line routing of the rinsing agent line may be less advantageous, as has already been mentioned.

The rinsing of the individual pump units may serve to rinse the piston shaft, as a result of which paint leakages along the piston are advantageously reduced and thus the paint is prevented from drying on behind the piston, which results in an improved service life of the wobble piston pump.

The individual pump units may each have at least one piston rod seal which seals off the respective wobble piston, the above-mentioned rinsing agent line being routed through the individual piston rod seals. For example, the piston rod seal can have a radial rinsing bore through which the rinsing agent is conducted.

The individual piston rod seals may have at least two sealing lips which project axially from the piston rod seal and bear from the outside against the lateral surface of the wobble piston.

Furthermore, it is possible within the context of the exemplary illustrations for the discharge direction of the wobble piston pump to be reversible in order to allow a reflow mode of the coating installation, the coating agent flowing through the wobble piston pump in the opposite direction during reflow operation. Alternatively, a bypass valve which bypasses the wobble piston pump can also be provided to do this. This bypass valve may be arranged without dead space between the pump inlet and the pump outlet, without additional connections being necessary for rinsing.

In one exemplary illustration, a wobble piston pump has a line part in which all the fluid lines are arranged, such as the branch lines, the rinsing agent line, the bypass line, the coating agent supply line and the coating agent output line. The line part therefore has a relatively complex shape and may be produced by the rapid prototyping already mentioned at the beginning. Alternatively, the line part can be produced by casting or cutting. This complex line component part can be replaced, so that the wobble piston pump can be repaired simply by replacing the line part.

Finally, it should also be mentioned that the exemplary illustrations are not restricted to a wobble piston pump as an individual component part. Rather, the exemplary illustration also comprise a coating installation or a coating device having such a wobble piston pump for metering a coating agent. An exemplary coating installation may have an atomiser (e.g. rotary atomiser, airless device, airmix device, ultrasound atomiser etc.), which applies a coating agent (e.g. wet paint, powder paint) to a part (e.g. motor vehicle body part). Furthermore, an exemplary coating installation may have an exemplary wobble piston pump, e.g., as described above, which is connected to the atomiser on the output side and meters the coating agent as required.

In this case it is possible for there to be no separate paint pressure regulator upstream of the wobble piston pump on the inlet side, as the discharge flow is independent of the pump supply pressure. The omission of a paint pressure regulator on the input side may advantageously allow the structure to be simplified and therefore also costs to be reduced.

A wobble piston pump, according to an exemplary illustration, can be arranged in an exemplary coating installation, for example, in a multi-axis coating robot, for example in a robot arm of the coating robot. Alternatively, it is also possible for the wobble piston pump to be arranged at a paint removal point or in a paint mixing chamber of the coating installation.

Finally, the exemplary illustrations also comprise the novel use of a wobble pump, e.g., an above-mentioned exemplary wobble piston pump, for discharging a coating agent, in particular paint or preservation agents such as wax, PVC (polyvinyl chloride) or adhesives in a coating installation. The exemplary wobble piston pumps are, however, also in principle suitable for metering other fluids, so the term coating agent used within the context of the exemplary illustrations should be understood generally.

The figures show a wobble piston pump 1 according to various exemplary illustrations, which can be used in a painting installation to meter the paint to be applied as required.

The wobble piston pump 1 may have a paint output 2, which is connected to an atomiser 3, the atomiser 3 and the line routing between the paint output 2 and the atomiser 3 only being shown schematically here.

Furthermore, the wobble piston pump 1 may have a paint input 4, to which a coating agent supply line 5 is connected to supply the paint to be metered.

The wobble piston pump 1 has a total of three pump units 6, 7, 8, which each have a cylinder and a wobble piston guided in the cylinder, the structure and function of the individual pump units 6-8 being largely conventional and described in detail below with reference to FIGS. 12A-12D.

The pump units 6-8 are connected in parallel on the inlet side and on the outlet side so that the pulsing discharge flows of the individual pump units 6-8 are superimposed on each other, which results in a smoothing of the discharge flow output at the paint output 2.

To this end, the inlets of the pump units 6-8 are connected via inlet-side branch lines 9-11 to a common inlet-side distributor point 12, which is in turn connected to the paint input 4.

Similarly, the outlet of the pump units 6-8 is connected via three outlet-side branch lines 13-15 to an outlet-side distributor point 16, which is in turn connected to the paint output 2.

Furthermore, the wobble piston pump 1 may have a bypass valve 17, which connects the paint input 4 directly to the paint output 2, bypassing the pump units 6-8. The bypass valve 17 is arranged directly between the paint input 4 and the paint output 2 without dead space, which prevents further paint losses.

Furthermore, the exemplary wobble piston pump 1 may have an input-side pressure sensor 18.1, which measures the pump input pressure at the paint input 4. Similarly, an output-side pressure sensor 18.2 may be provided, which is connected to the paint output 2 and measures the output pressure of the wobble piston pump 1.

Finally, the exemplary wobble piston pump 1 may allow rinsing with a rinsing agent, which is used to clean the piston and thereby increases the service life. To this end, the wobble piston pump 1 has a rinsing agent inlet 19 and a rinsing agent outlet 20, a rinsing agent line 21 running through the pump units 6-8 consecutively via a rinsing agent valve 22 in order to rinse the pump units 6-8, as is described in detail with reference to FIG. 10.

Figure 2:
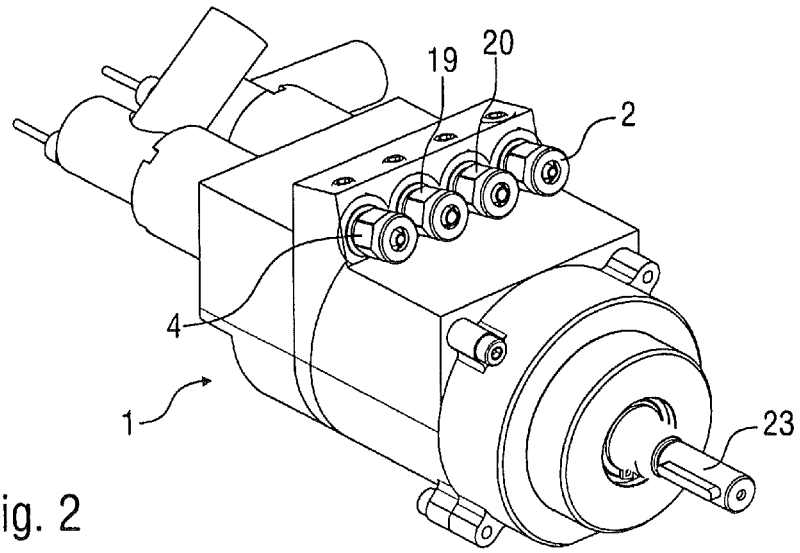
Figure 3:
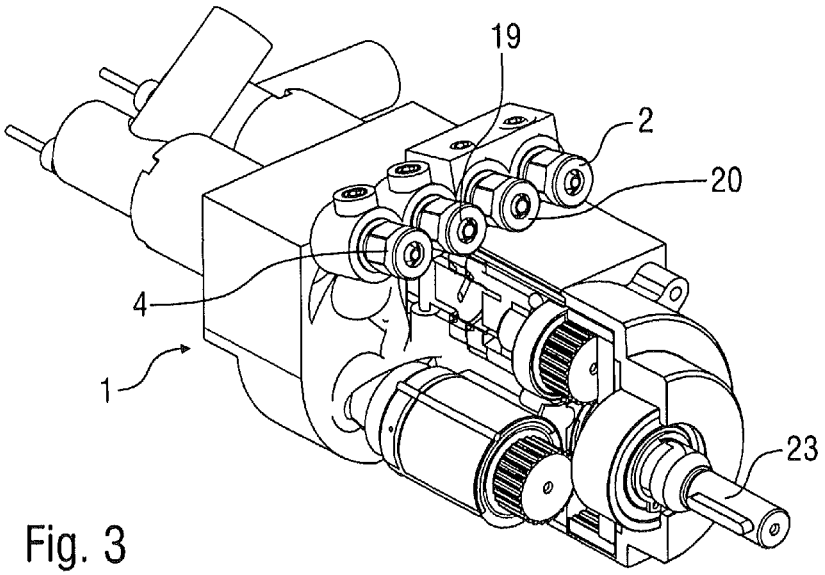

FIGS. 2 and 3 show perspective views of the wobble piston pump 1. It can also be seen here that the wobble piston pump 1 may be driven by a common drive shaft 23, the drive shaft 23 generally being connected to an electric motor.

Figure 4:
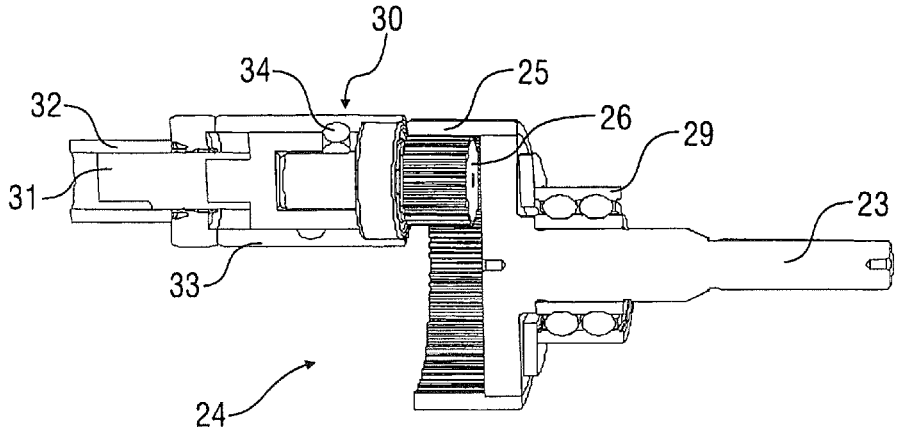
Figure 5:
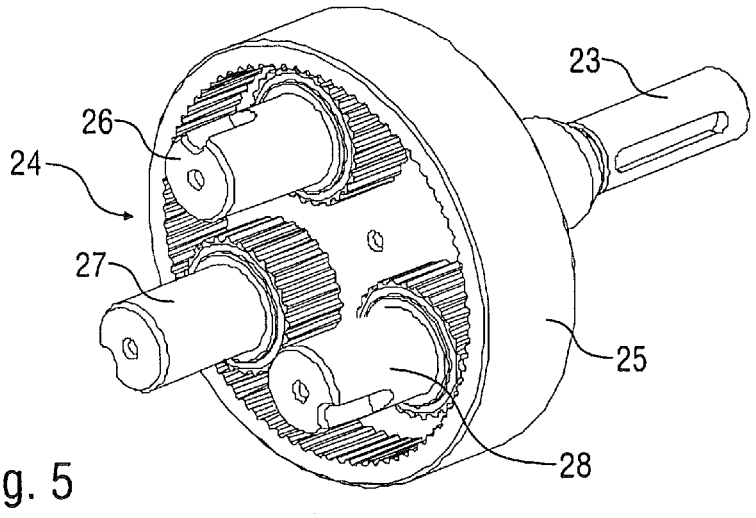

FIGS. 4 and 5 show a toothed gear mechanism 24, which may be used in the wobble piston pump 1 to distribute the torque of the drive shaft 23 to the individual pump units 6-8. To this end, the toothed gear mechanism 24 may have an internal gear wheel 25 and three planetary gear wheels 26, 27, 28, the planetary gear wheels 26-28 engaging with their external toothing in a correspondingly matching internal toothing of the internal gear wheel 25. The drive shaft 23 is in this case mounted in a bearing 29 and drives the internal gear wheel 25 so that the individual planetary gear wheels 26-28 turn at a corresponding gear ratio.

FIG. 4 also shows a conversion gear mechanism 30 which converts the pure rotary movement of the planetary gear wheel 26 into a wobble movement of a wobble piston 31, so that the wobble piston 31 executes a combined rotary and stroke movement in a cylinder 32.

To this end, the conversion gear mechanism 30 has a control bushing 33, in which a circumferential control curve in the form of a groove is arranged. Control balls 34, which are fixed in the circumferential direction with respect to the planetary gear wheel 26, engage in this groove, as a result of which the rotary movement of the planetary gear wheel 26 is converted into a combined rotary and stroke movement of the wobble piston 31.

Figure 6:
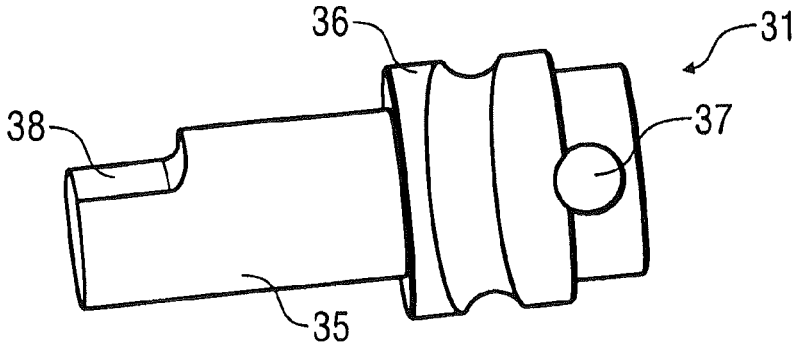
Figure 7:
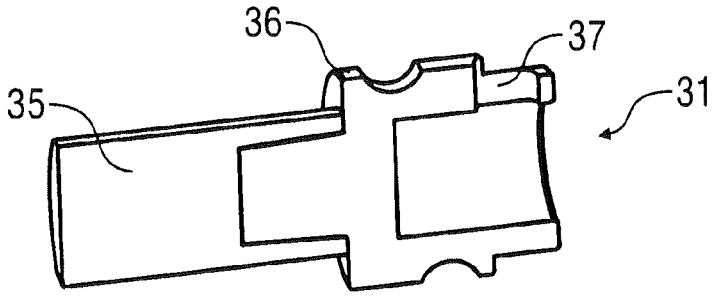

FIGS. 6 and 7 show the structure of the individual wobble pistons 31 consisting, e.g., of a piston head 35 of ceramic (e.g. silicon nitride) and a piston shaft 36 of hardened steel, the piston head 35 being adhesively bonded to the piston shaft 36.

In the piston shaft 36 there is in this case a receiving bore 37 for receiving control balls.

Furthermore, it can be seen from FIG. 6 that the piston head 35 has a control groove 38 on its front in order to open or close the inlet or outlet of the cylinder 32, as is described in more detail with reference to FIGS. 12A-12D.

Figure 8:
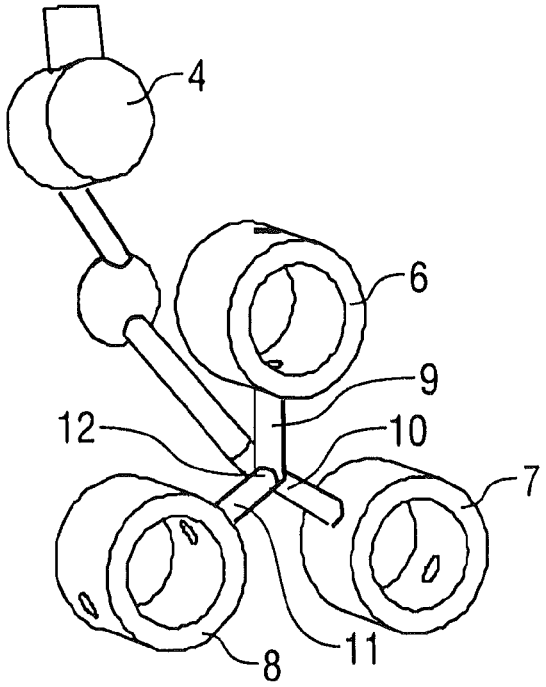

FIG. 8 shows exemplary line routings in the wobble piston pump 1 on the inlet side of the pump units 6-8 in a schematic form. It can be seen here that the branch lines 9-11 connect the inlet-side distributor point 12 to the pump units 6-8 by the shortest route and in a kink-free manner. Furthermore, it can be seen from this diagram that the different branch lines 9-11 have the same duct length between the inlet-side distributor point 12 and the pump units 6-8, which may be important for pulsation-free discharge.

Figure 9:
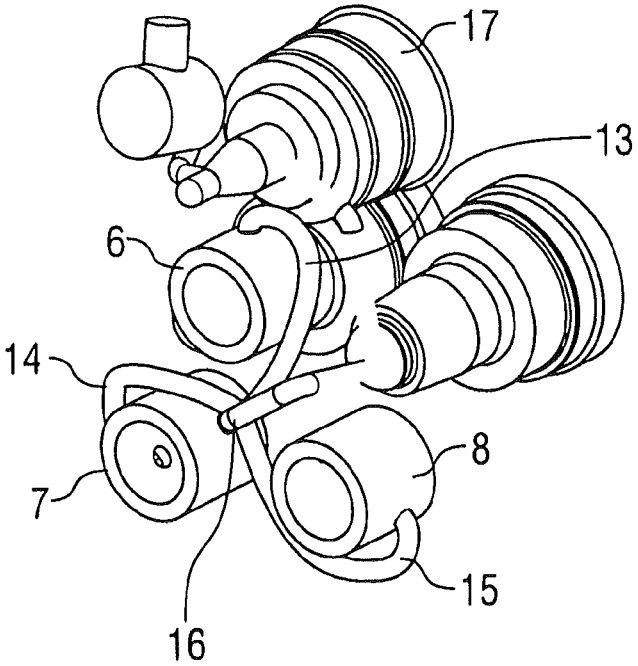

FIG. 9 correspondingly shows the line routing in the wobble piston pump, according to an exemplary illustration, on the outlet side of the pump units 6-8. It can be seen here that the outlet-side branch lines 13-15 run in a kink-free manner between the output-side distributor point 16 and the pump units 6-8 and have the same length.

Figure 10:
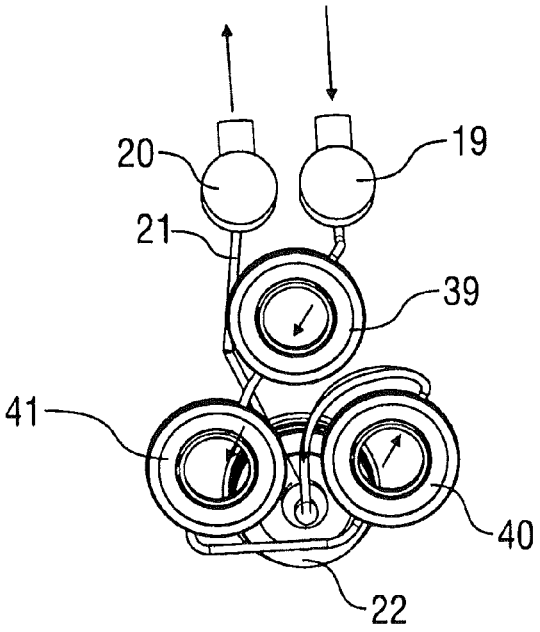

FIG. 10 schematically shows the profile of the rinsing agent line 21 in the wobble piston pump 1 according to an exemplary illustration. It can be seen here that the rinsing agent flows through the piston rod seals 39-41 consecutively between the rinsing agent inlet 19 and the rinsing agent outlet 20, flow passing through the individual piston rod seals 39-41 in the radial direction.

Figure 11A:
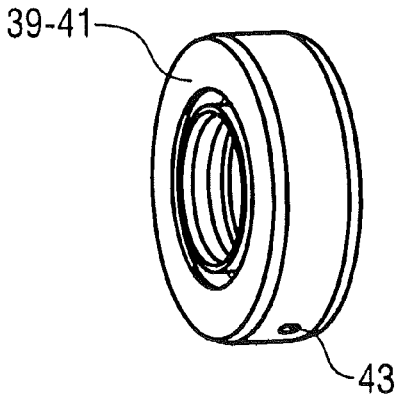
Figure 11B:
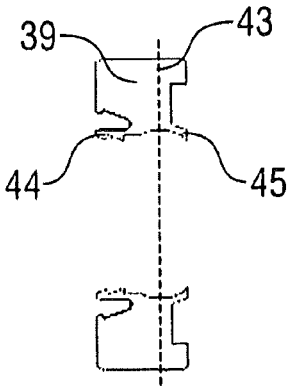

To this end, the individual piston rod seals 39-41 may each have a radial rinsing bore 43, as can be seen in FIGS. 11A and 11A. Furthermore, it can be seen from these drawings that the piston rod seals 39-41 may each have two sealing lips 44, 45, which each project axially in opposite directions and bear from outside against the lateral surface of the wobble pistons 31.

The basic function of the individual pump units 6-8 of the wobble piston pump 1 is described below with reference to FIGS. 12A-12D.

The individual pump units 6-8 thus each have the cylinder 32, in which the wobble piston 31 can execute a wobble movement, the wobble movement consisting of a combined rotary and stroke movement.

At its front end, the wobble piston 31 may have the control groove 38 in order to open either an inlet 46 or an outlet 47.

Figure 12A:
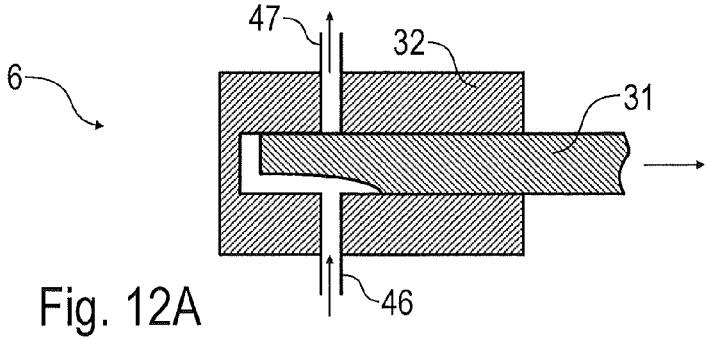

The filling phase is described first below with reference to FIG. 12A. The wobble piston 31 is turned in such a manner that the control groove 38 opens the inlet 46, while the wobble piston 31 closes the outlet 47 with its lateral surface. The wobble piston 31 is then drawn axially out of the cylinder 32 in the direction of the arrow, as a result of which the coating agent is drawn via the inlet 46 into the cylinder 32. In this idealised form, only a linear stroke movement takes place in the filling phase, without any additional rotation of the wobble piston 31.

Figure 12B:
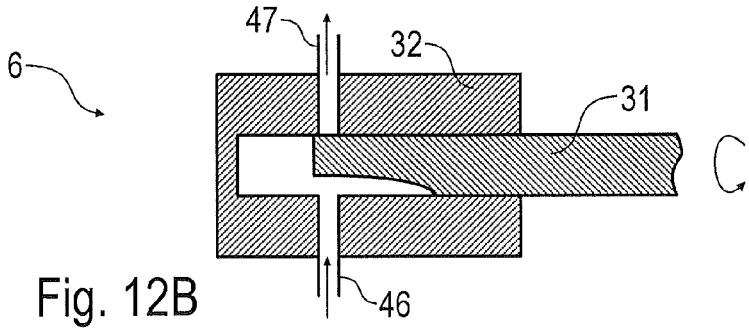

FIG. 12B, on the other hand, shows the state of the wobble piston 31 in the bottom dead centre of the stroke movement. In this state, the wobble piston 31 is rotated about its longitudinal axis in such a manner that the inlet 46 is closed, while the outlet 47 is opened at the end of the rotary movement, as is shown in FIG. 12C.

Figure 12C:
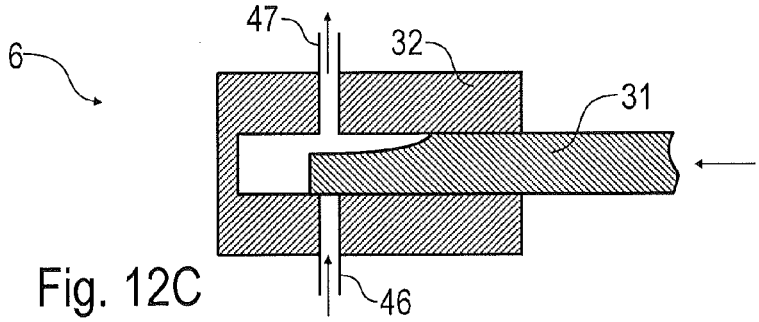

In the discharge phase according to FIG. 12C, the wobble piston 31 is then pushed into the cylinder 32 without a rotary movement, as a result of which the previously received coating agent is pushed out of the cylinder 32 via the outlet 47.

Figure 12D:
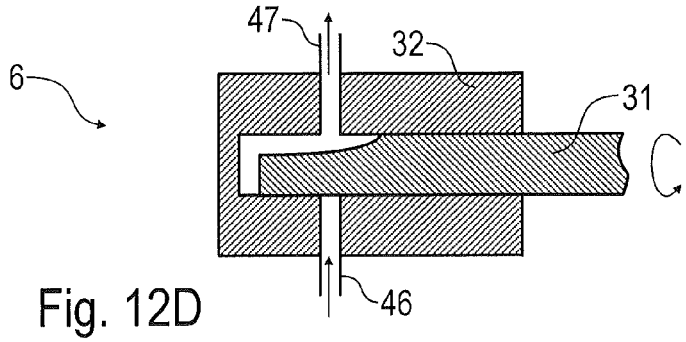

FIG. 12D schematically shows the state of the wobble piston 31 in top dead centre. In this state, the wobble piston 31 is again rotated so that the inlet 46 is opened, while the outlet 47 is closed.

The above-described phases according to FIGS. 12A-12D may then be repeated cyclically during operation.

Figure 13:
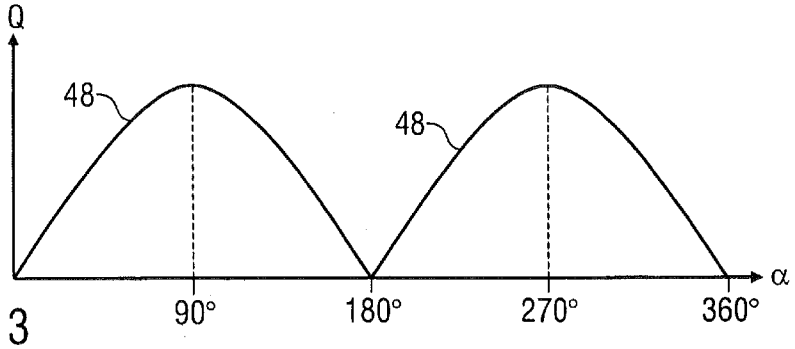

FIG. 13 shows the profile of a discharge flow Q depending on the angle $\alpha$ of the common drive shaft 23 for a wobble piston pump having two pump units in parallel. It can be seen here that the discharge phases 48 of the individual pump units are superimposed, which results in a smoothing of the pulsation.

Figure 14:
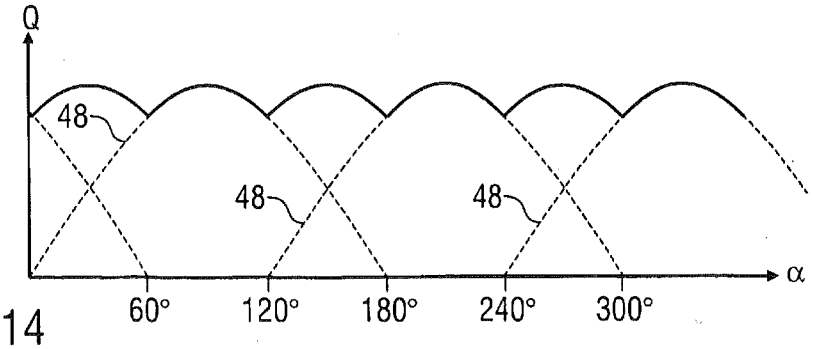

FIG. 14 shows the same profile of the discharge flow Q for the exemplary wobble piston pump 1 having the three pump units 6-8. In this case, too, the discharge phases 48 of the individual pump units 6-8 are superimposed, which results in a correspondingly better smoothing of the discharge flow Q.

Figure 15:
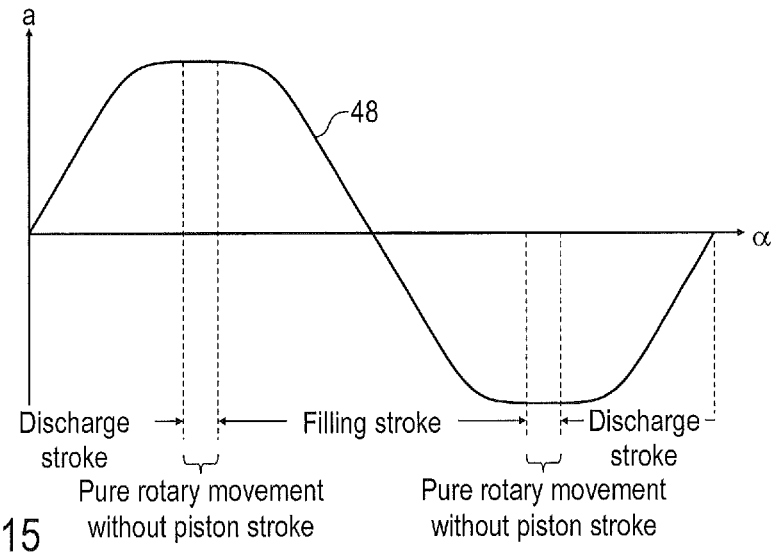

FIG. 15 shows a possible profile of a control curve 49 of the conversion gear mechanism 30 which converts a pure rotary movement into the desired wobble movement. It can be seen here that the control curve 49 has a region in which the wobble piston 31 does not execute a stroke in the region of its dead centres, which corresponds to FIGS. 12B and 12D.

Furthermore, it can be seen that the control curve 49 has an approximately linear region between the dead centres of the wobble piston 31, in which region the wobble piston 31 therefore moves at a constant piston speed, which correspondingly results in a constant discharge flow.

The aim of this is in this case that the sum of all the individual discharge flows of the pump units is constant at all angle positions.

Figure 16:
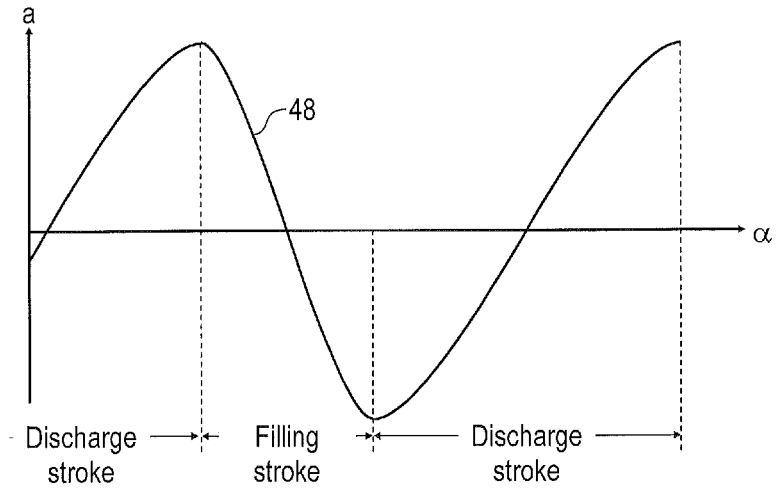

FIG. 16 shows a modification of the exemplary control curve according to FIG. 15. A particularity of this consists in that the gradient of the control curve is relatively steep during the filling stroke and relatively flat during the discharge stroke. The result of this is that the wobble piston 31 moves relatively quickly during the filling stroke and relatively slowly during the discharge stroke.

Figure 17:
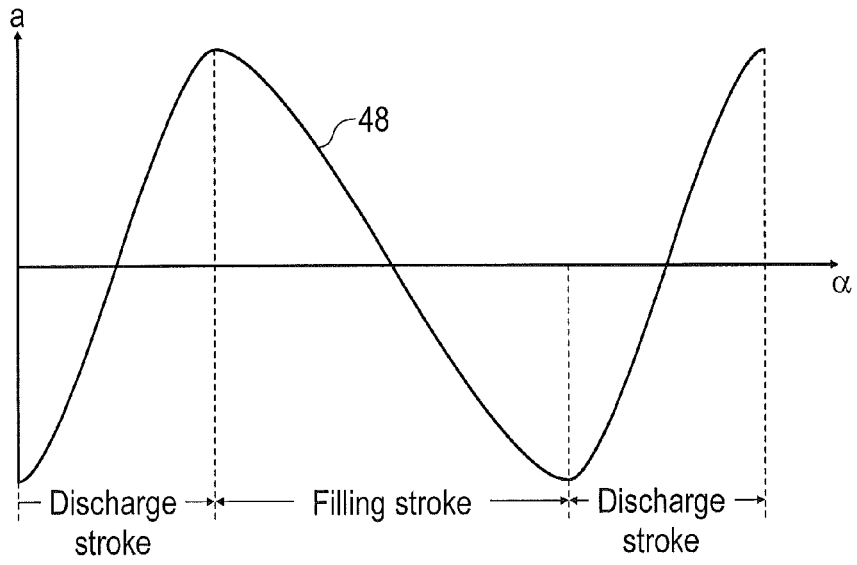

FIG. 17 shows a modification of the exemplary control curve of FIG. 16. In this case, the control curve has a relatively flat gradient during the filling stroke and a relatively large gradient during the discharge stroke. The result of this is that the wobble piston 31 moves relatively slowly during the filling stroke and relatively quickly during the discharge stroke.

Figure 18:
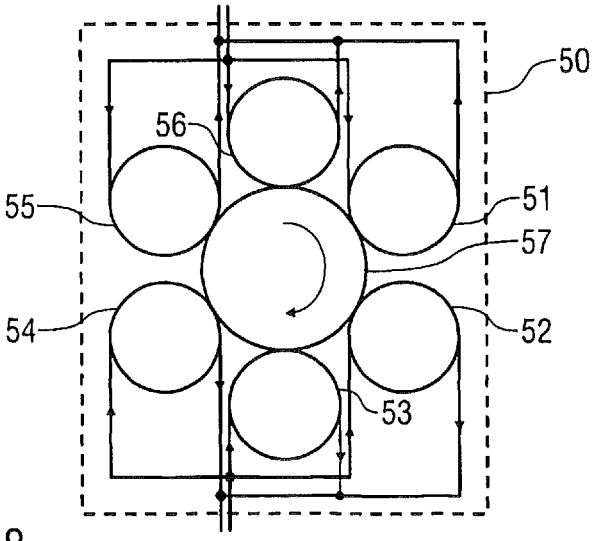

FIG. 18 shows a multi-component pump 50, according to an exemplary illustration, which can be used for example in a painting installation in order to discharge different components of a coating agent separately from each other.

To this end, the multi-component pump 50 has a total of six pump units 51-56, which are each configured as wobble piston pumps.

The pump units 51, 55 and 56 are in this case used to meter a first component (e.g. master batch paint) of the coating agent, so the pump units 51, 55 and 56 are connected in parallel on the input side and on the output side. This parallel connection has the above-mentioned advantage of smoothing the pulsing discharge flows.

The mixing ratio of a component A with a component B can in this case be set by different stroke lengths and different piston diameters.

The other pump units 52, 53, 54 are used to meter a second component (e.g. hardener) of the coating agent. These pump units 52-54 are therefore also connected together on the input side as well as on the output side and therefore operate in parallel, which advantageously results in a corresponding smoothing of the pulsation.

A further particularity of the multi-component pump 50 consists in the drive by means of a central sun wheel 57.

Figure 19:
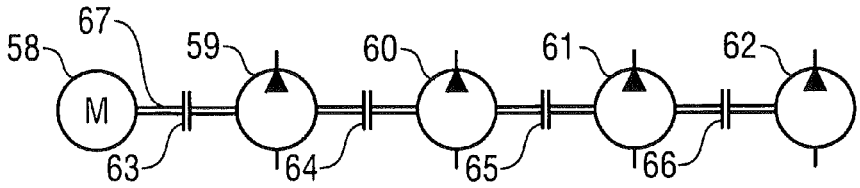

FIG. 19 shows a pump arrangement having an electric motor 58 and a plurality of pump units 59-62, which are each connected to each other and to the electric motor 58 by means of separable clutches 63-66, according to an exemplary illustration. The pump arrangement therefore has a drive shaft 67, which is divided into a plurality of shaft sections, the individual shaft sections each driving one of the pump units 59-62.

Figure 20:
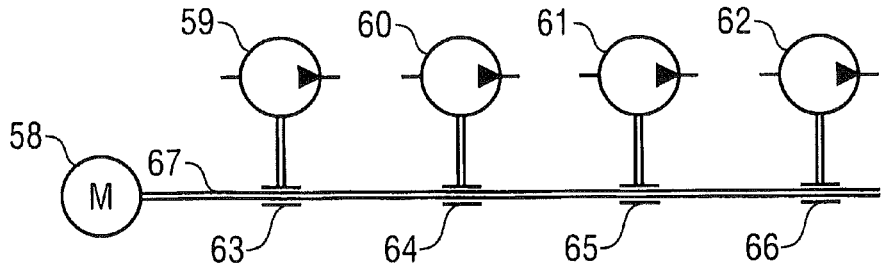

FIG. 20 shows a somewhat modified pump arrangement, which partially corresponds to the exemplary pump arrangement according to FIG. 19, so that, to avoid repetition, reference is made to the above description, the same reference numerals being used for corresponding details.

A particularity of this exemplary illustration consists in that the drive shaft 67 is continuous and the individual pump units 59-62 can each be connected to the drive shaft 67 selectively by means of the associated clutch 63-66.

Figures 21A, 21B, 21C, 21D:
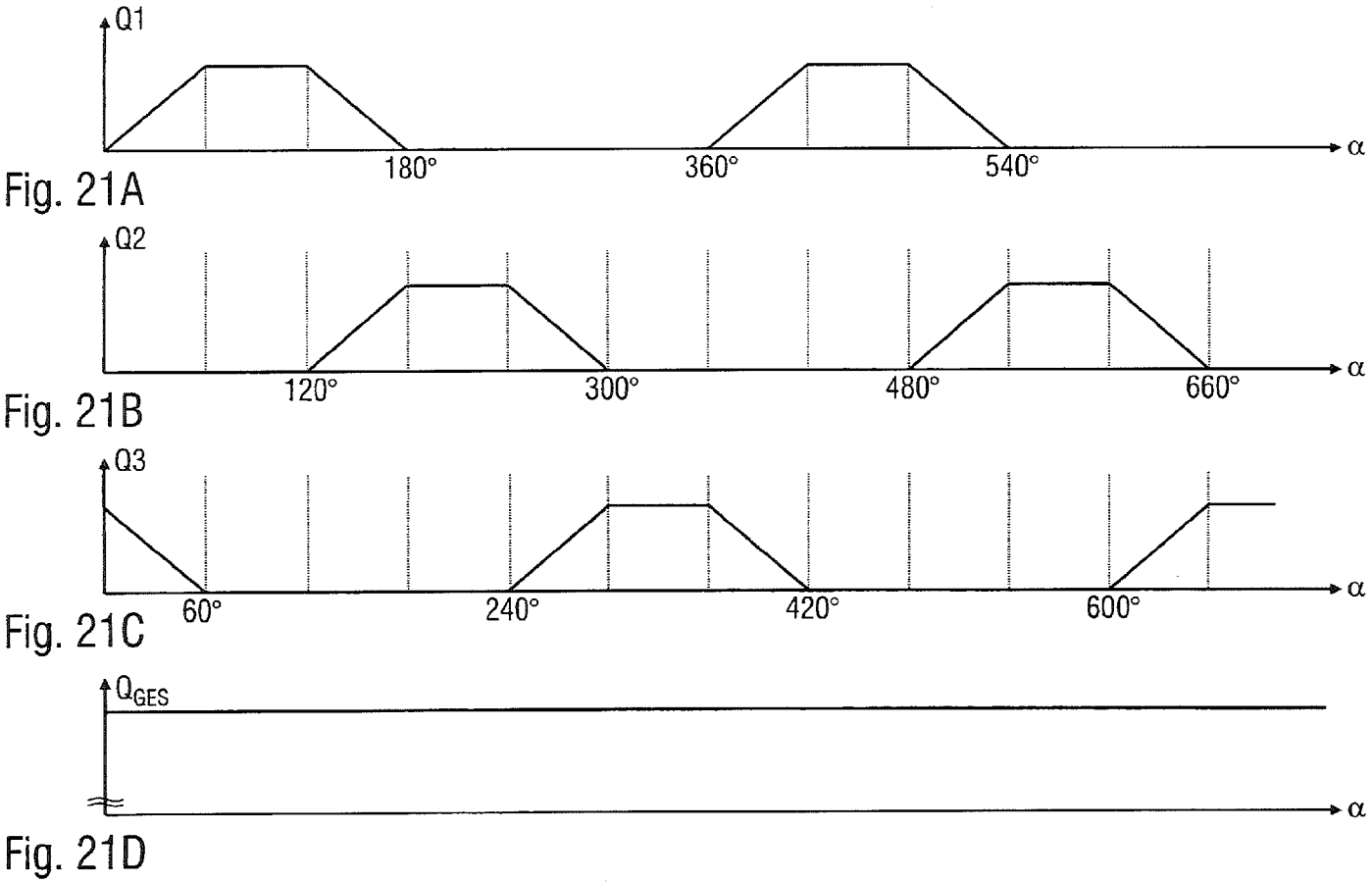

FIGS. 21A-21D show the chronological profile of the discharge flow in a pulsation-free wobble piston pump with three pump units. FIGS. 21A-21C show in this case the discharge flows Q1-Q3 of the individual pump units, whereas FIG. 21D shows the total discharge flow QGES of the wobble piston pump arising from the superposition of the discharge flows Q1-Q3 of the individual pump units. The discharge flows Q1-Q3 of the individual pump units are in this case selected by a suitable design of the respective control curve in such a manner that the total discharge flow QGES is pulsation-free.

Figure 22:
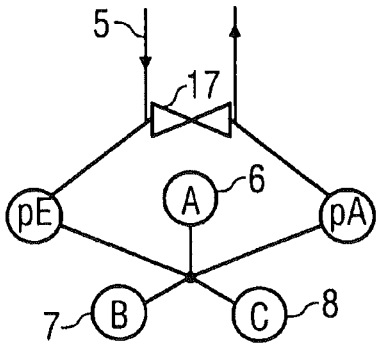

FIG. 22 shows a schematic representation of an exemplary wobble piston pump having three pump units 6-8 and a bypass valve 17 between the paint input and the paint output. The wobble piston pump according to FIG. 22 largely corresponds to the exemplary wobble piston pump according to FIG. 1, so, to avoid repetition, reference is made to the above description with the same reference numerals being used for corresponding details.

It should be mentioned here that the bypass valve 17 is arranged without dead space between the paint input and the paint output, without additional connecting bores being necessary.

Figure 23:
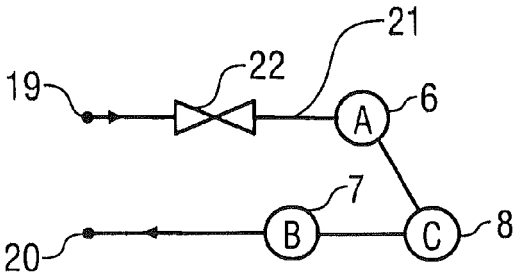

FIG. 23 shows a schematic and simplified representation of a wobble piston pump according to an exemplary illustration with three pump units 6-8, this wobble piston pump likewise largely corresponding to the wobble piston pump according to FIG. 1, so, to avoid repetition, reference is made to the above description, the same reference numerals being used for corresponding details.

This representation shows how the pistons of the individual pump units 6-8 are rinsed with a rinsing agent via the rinsing agent valve 22, the individual pump units 6-8 being rinsed in series. The pump units 6-8 are therefore arranged consecutively along the rinsing agent line 21.

Figure 24:
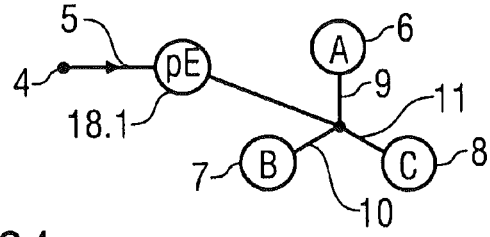
Figure 25:
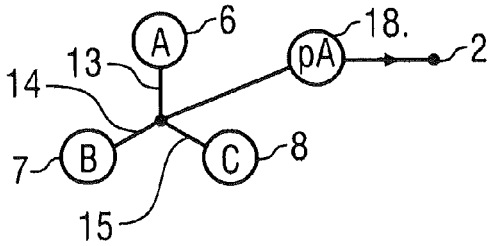

FIGS. 24 and 25 show that the inlet-side branch lines 9-11 may have the same length, and the outlet-side branch lines 13-14 may also be of equal length. This may be advantageous, because the coating agent flowing in via the common coating agent supply line 5 then also reaches the different pump units 6-8 at the same time.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. A wobble piston pump for metering a coating agent in a coating installation, the wobble piston pump comprising:

a plurality of pump units, each of the pump units having one cylinder and one wobble piston that executes a wobble movement in the cylinder during operation; and a drive shaft and a drive gear coupled to the drive shaft;

each pump unit having a driven gear coupled to each wobble piston, each driven gear being engaged with the drive gear and axially fixed relative to the drive gear;

wherein each of the individual pump units are connected to the drive shaft by a conversion gear mechanism;

wherein the conversion gear mechanism controls the piston position of the wobble piston in compliance with a predefined control curve determined at least in part by a rotary angle of the drive shaft; and wherein the control curve of the conversion gear mechanism deviates from a sine curve, so that the stroke movement of the wobble piston is not sinusoidal.

2. The wobble piston pump according to claim 1, wherein the drive gear is an internal gear wheel with internal toothing and the driven gears are planetary gear wheels engaging in the internal gear wheel and each having external toothing, wherein the internal gear wheel is driven by the drive shaft and wherein the wobble pistons of the pump units are driven by the planetary gear wheels.

3. The wobble piston pump according to claim 1, wherein the drive gear is a central sun wheel with external toothing and the driven gears are planetary gear wheels engaging in the sun wheel, each planetary gear wheel having external toothing, wherein the drive shaft drives the sun wheel and wherein the wobble pistons of the pump units are driven by the planetary gear wheels.

4. The wobble piston pump according to claim 1, wherein the individual pump units each discharge a pulsing discharge flow of the coating agent, and the pump units include an outlet side connected to a common pump outlet so that the pulsing discharge flows of the individual pump units are superimposed on each other, which results in a smoothing of the pulsing discharge flow, and the pump units include an inlet side connected to a common pump inlet so that the pump units receive the coating agent via the common pump inlet.

5. The wobble piston pump according to claim 1, wherein the wobble piston pump is adapted for separately discharging a plurality of components of the coating agent.

6. The wobble piston pump according to claim 5, wherein at least one pump unit is provided for each component of the coating agent.

7. The wobble piston pump according to claim 5, wherein a plurality of pump units is provided for each component of the coating agent, which pump units are connected together on an inlet side and on an outlet side and discharge the respective component together.

8. The wobble piston pump according to claim 1, wherein the pump units are driven by the drive shaft with a certain phase difference, and the phase difference is equal to 360° divided by the number of pump units.

9. The wobble piston pump according to claim 1, wherein the individual wobble pistons each are formed of a composite of different materials.

10. The wobble piston pump according to claim 9, wherein the individual wobble pistons each are formed of one of ceramic and steel.

11. The wobble piston pump according to claim 9, wherein the individual wobble pistons each have a piston head formed of a ceramic material and a piston skirt formed of a steel material.

12. The wobble piston pump according to claim 11, wherein the piston head is adhesively bonded, pressed, or screw-fastened to the piston skirt.

13. The wobble piston pump according to claim 10, wherein the ceramic is selected from a group consisting of silicon nitride, zirconium oxide and aluminium oxide.

14. The wobble piston pump according to claim 1, wherein the individual pump units are connected mechanically to the drive shaft by means of one separable clutch each.

15. The wobble piston pump according to claim 1, wherein the drive shaft is divided into a plurality of sections by separable clutches, wherein the individual sections of the drive shaft each drive at least one of the pump units.

16. The wobble piston pump according to claim 1, wherein the conversion gear mechanism converts a rotary movement of the drive shaft into a combined rotary and stroke movement of the respective wobble piston.

17. The wobble piston pump according to claim 1, wherein the conversion gear mechanism converts an oscillating stroke movement of the drive shaft into a combined rotary and stroke movement of the wobble pistons.

18. The wobble piston pump according to claim 1, wherein the control curve of the conversion gear mechanism is stroke-free in a region around the dead centres of the piston movement, so the wobble pistons only execute a rotary movement in the stroke-free region, and the stroke-free region of the piston movement is a rotary angle range of the planetary gear wheels of at least 5°.

19. The wobble piston pump according to claim 1, wherein the control curve has a discharge phase and a filling phase, wherein the wobble piston pump receives the coating agent in the filling phase and ejects the received coating agent in the discharge phase, and the discharge phases of the individual pump units join without chronological gaps or overlaps in order to achieve a discharge flow with the least possible pulsation.

20. The wobble piston pump according to claim 1, wherein the stroke movement of the wobble piston is quicker in the filling phase than in the discharge phase.

21. The wobble piston pump according to claim 1, wherein the stroke movement of the wobble piston is slower in the filling phase than in the discharge phase.

22. The wobble piston pump according to claim 1, wherein the stroke movement of the wobble piston takes place at an essentially constant piston speed in a filling phase.

23. The wobble piston pump according to claim 1, wherein the stroke movement of the wobble piston takes place at an essentially constant piston speed in a discharge phase, so the discharge flow in the discharge phase is essentially constant.

24. The wobble piston pump according to claim 1, wherein the control curves, the piston strokes and/or the piston diameters of the individual pump units are different in order to set a certain mixing ratio of components.

25. The wobble piston pump according to claim 1, further comprising:

a common coating agent supply line for supplying the coating agent for all the pump units, an inlet-side distributor point, which is arranged in the coating agent supply line, and a plurality of inlet-side branch lines, which branch off from the common coating agent supply line in the inlet-side distributor point and lead to the individual pump units.

26. The wobble piston pump according to claim 25, wherein the inlet-side branch lines between the inlet-side distributor point and the pump units have essentially the same length, and the inlet-side branch lines between the inlet-side distributor point and the pump units are kink-free, and the inlet-side branch lines between the inlet-side distributor point and the pump units have a line profile with a minimal flow resistance, and the inlet-side branch lines connect the inlet-side distributor point to the pump units by the shortest route, and the coating agent supply line and the inlet-side branch lines are free of dead space.

27. The wobble piston pump according to claim 1, further comprising:

a common coating agent output line for receiving the coating agent from all the pump units, an outlet-side distributor point, which is arranged in the coating agent output line, and a plurality of outlet-side branch lines, which branch off from the common coating agent output line in the outlet-side distributor point and lead to the individual pump units.

28. The wobble piston pump according to claim 27, wherein the outlet-side branch lines between the outlet-side distributor point and the pump units have essentially the same length, and the outlet-side branch lines between the outlet-side distributor point and the pump units are kink-free, and the outlet-side branch lines between the outlet-side distributor point and the pump units have a line profile with a minimal flow resistance, and the outlet-side branch lines connect the outlet-side distributor point to the pump units by the shortest route, and the coating agent output line and the outlet-side branch lines are free of dead space.

29. The wobble piston pump according to claim 25, wherein the inlet-side distributor point is connected to an inlet-side pressure sensor, which measures the pump admission pressure, and an outlet-side distributor point is connected to an outlet-side pressure sensor, which measures the pump output pressure.

30. The wobble piston pump according to claim 1, further comprising:

a rinsing agent inlet for supplying a rinsing agent, a rinsing agent outlet for recycling the rinsing agent, and a rinsing agent line which leads from the rinsing agent inlet through the pump units to the rinsing agent outlet.

31. The wobble piston pump according to claim 30, wherein the rinsing agent line is branch-free in the wobble piston pump, and the individual pump units each have a piston rod seal, which seals off the respective wobble piston, wherein the rinsing agent line is routed through the individual piston rod seals, and the rinsing agent line is in each case routed radially through a radial rinsing bore in the piston rod seals, and the pump units are arranged consecutively along the rinsing agent line so that the pump units are rinsed in series.

32. The wobble piston pump according to claim 1, wherein the individual pump units each have a piston rod seal, which seals off the respective wobble piston, and the piston rod seals each have at least two sealing lips, which project axially from the piston rod seal and bear from the outside against the lateral surface of the wobble piston, and the piston rod seals each have a piston shaft back rinsing system.

33. The wobble piston pump according to claim 1, wherein the discharge direction of the wobble piston pump is reversible in order to allow reflow operation of the coating installation by conducting the coating agent back through the wobble piston pump.

34. The wobble piston pump according to claim 1, wherein an integrated bypass valve is provided to bypass all the pump units between a pump inlet and a pump outlet via a bypass line.

35. The wobble piston pump according to claim 34, wherein the bypass valve is arranged without dead space between the pump inlet and the pump outlet.

36. The wobble piston pump according to claim 1, wherein all the fluid lines of the wobble piston pump are arranged in a single line part of the wobble piston pump, and the line part is replaceable, and at least one part of the wobble piston pump is produced by a rapid prototyping method.

37. The wobble piston pump according to claim 1, wherein the wobble piston pump discharges a pulsation-free discharge flow.

38. The wobble piston pump according to claim 1, further comprising:

a common coating agent supply line for supplying the coating agent for all the pump units, an inlet-side distributor point, which is arranged in the coating agent supply line, a plurality of inlet-side branch lines, which branch off from the common coating agent supply line in the inlet-side distributor point and lead to the individual pump units;

a common coating agent output line for receiving the coating agent from all the pump units, an outlet-side distributor point, which is arranged in the coating agent output line, and a plurality of outlet-side branch lines, which branch off from the common coating agent output line in the outlet-side distributor point and lead to the individual pump units.

39. The wobble piston pump according to claim 1, further comprising a control bushing defining a circumferential groove and wherein each pump unit includes a control ball circumferentially fixed to the driven gear and engaged in the groove to convert rotary movement of the driven gear into combined rotary and stroke movement of the wobble piston.

40. A coating installation comprising:

an atomiser for applying a coating agent, a metering pump for metering the coating agent, wherein the metering pump is connected on the output side to the atomiser, wherein the metering pump is a wobble piston pump comprising:

a plurality of pump units, each of the pump units having one cylinder and one wobble piston that executes a wobble movement in the cylinder during operation; and a drive shaft and a drive gear coupled to the drive shaft;

each pump unit having a driven gear coupled to each wobble piston, each driven gear being engaged with the drive gear and axially fixed relative to the drive gear;

wherein each of the individual pump units are connected to the drive shaft by a conversion gear mechanism;

wherein the conversion gear mechanism controls the piston position of the wobble piston in compliance with a predefined control curve determined at least in part by a rotary angle of the drive shaft; and wherein the control curve of the conversion gear mechanism deviates from a sine curve, so that the stroke movement of the wobble piston is not sinusoidal.

41. The coating agent installation according to claim 40, wherein there is no paint pressure regulator connected upstream of the wobble piston pump on an inlet side.

42. The coating installation according to claim 40, wherein the wobble piston pump is arranged in a multi-axis coating robot.

43. The wobble piston pump according to claim 40, wherein the wobble piston pump is arranged at a paint removal point of the coating installation.

44. The wobble piston pump according to claim 40, wherein the wobble piston pump is arranged in a paint mixing chamber of the coating installation.

* * * * *